US012076653B2

(12) United States Patent
Martiniak

(10) Patent No.: US 12,076,653 B2
(45) Date of Patent: Sep. 3, 2024

(54) CHESS SET WITH INTERMESHING GAME PIECES

(71) Applicant: Chris Martiniak, Berkeley, CA (US)

(72) Inventor: Chris Martiniak, Berkeley, CA (US)

( * ) Notice: Subject to any disclaimer, the term of this patent is extended or adjusted under 35 U.S.C. 154(b) by 82 days.

(21) Appl. No.: 17/975,427

(22) Filed: Oct. 27, 2022

(65) Prior Publication Data

US 2023/0140345 A1 May 4, 2023

Related U.S. Application Data

(60) Provisional application No. 63/274,779, filed on Nov. 2, 2021.

(51) Int. Cl.
*A63F 3/00* (2006.01)

(52) U.S. Cl.
CPC ..... *A63F 3/00697* (2013.01); *A63F 3/0023* (2013.01); *A63F 2003/00246* (2013.01); *A63F 2003/00719* (2013.01)

(58) Field of Classification Search
CPC ..... A63F 3/00697; A63F 2003/00719; A63F 2003/00716; A63F 2003/007; A63F 3/02; A63F 2003/00946; A63F 2003/00249
See application file for complete search history.

(56) References Cited

U.S. PATENT DOCUMENTS

| | | | | |
|---|---|---|---|---|
| 3,677,550 | A * | 7/1972 | Mathers | A63F 3/00697 273/288 |
| 3,806,128 | A | 4/1974 | Endfield | |
| D277,015 | S * | 1/1985 | Elliott | D21/389 |
| 5,314,189 | A * | 5/1994 | Kerivan | A63F 3/00697 273/288 |
| 5,895,046 | A | 4/1999 | Lee | |
| 7,178,804 | B1 | 2/2007 | Traylor | |
| 7,766,336 | B2 | 8/2010 | Katz | |
| 2014/0120798 | A1 * | 5/2014 | Finn | A63H 33/086 446/125 |
| 2015/0321115 | A1 * | 11/2015 | Hower | A63F 9/1208 446/124 |
| 2021/0205695 | A1 * | 7/2021 | Fustino | A63F 3/00697 |

* cited by examiner

*Primary Examiner* — Michael D Dennis
(74) *Attorney, Agent, or Firm* — GSS Law Group; Gregory S. Smith; Phillip M. Wagner

(57) ABSTRACT

A chess set includes two or more chess pieces that have radial symmetry around a vertical axis and having rank-identifying shapes similar to those found in common Staunton style chess pieces. The chess pieces are designed such that at least two of the pieces can intermesh or combine with one another to result in a meshed pair that can be stored in less than 65% of the space that would be required to store the two pieces if stored separately.

17 Claims, 12 Drawing Sheets

Fig. 9
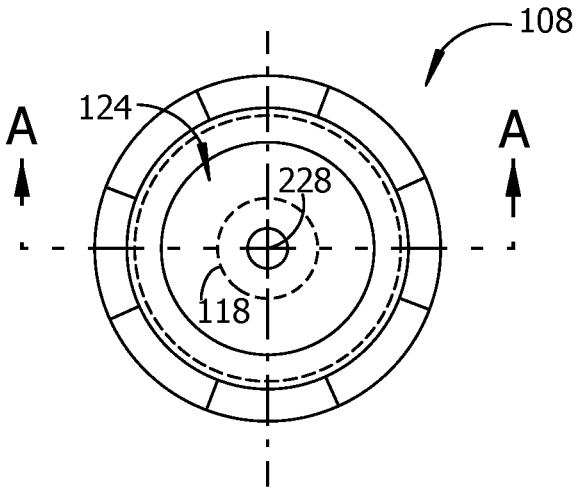
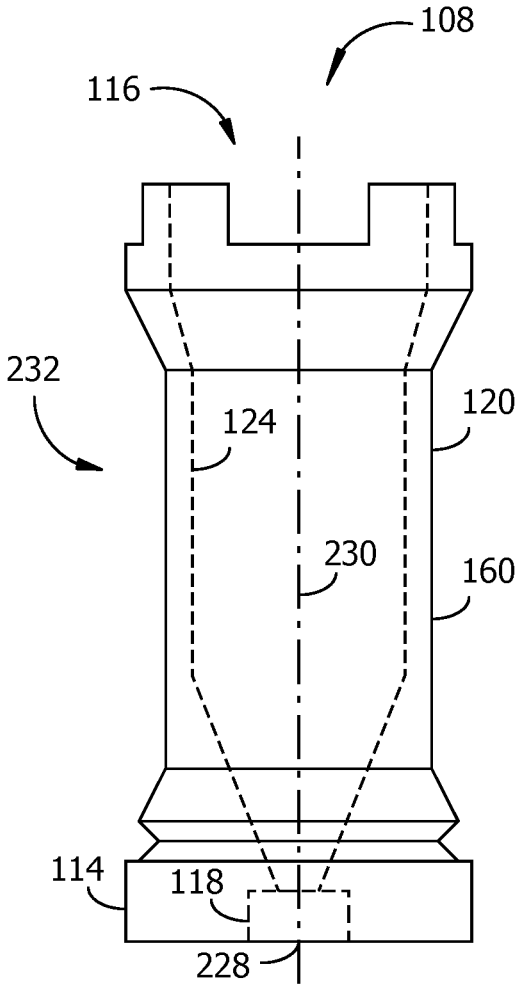
Fig. 10
Section A - A
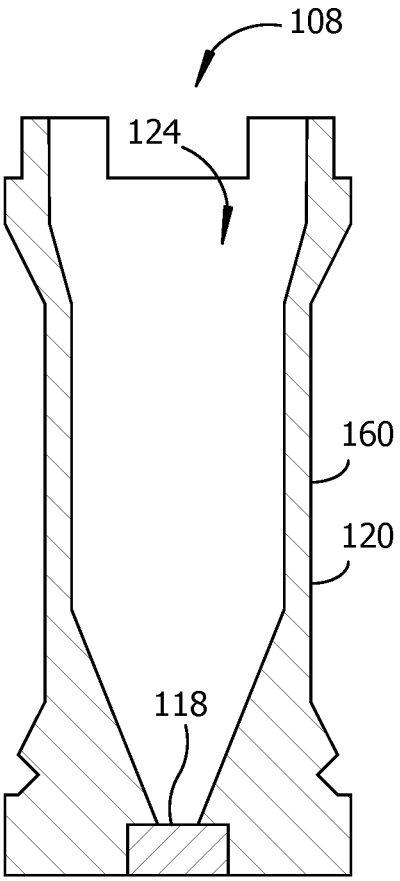
Fig. 11

Fig.20
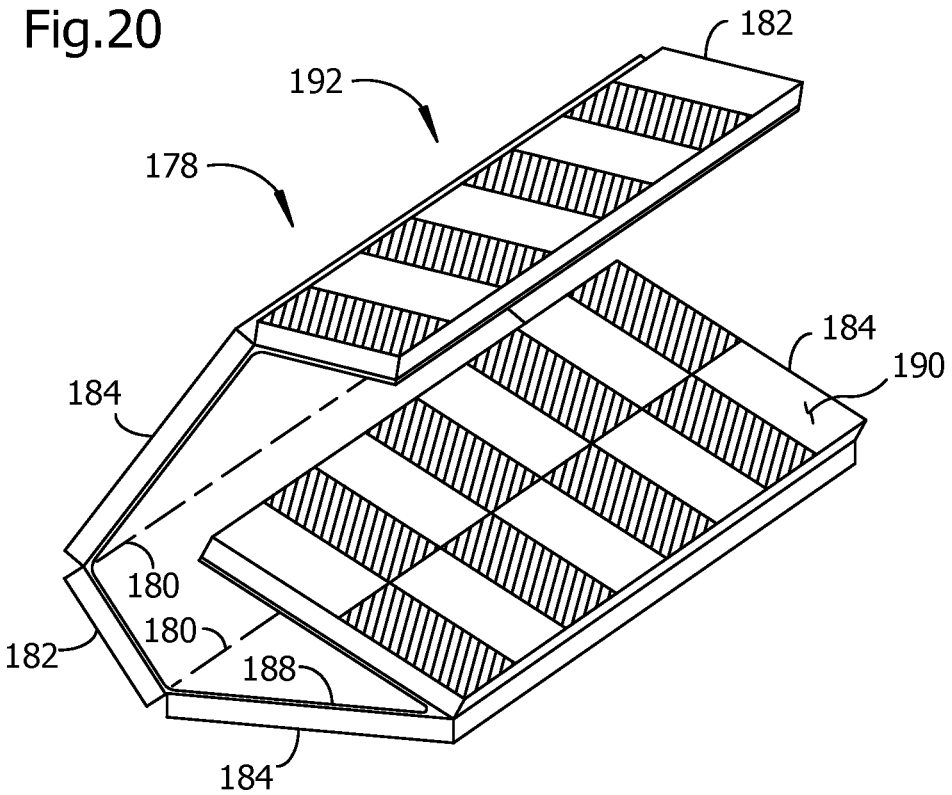
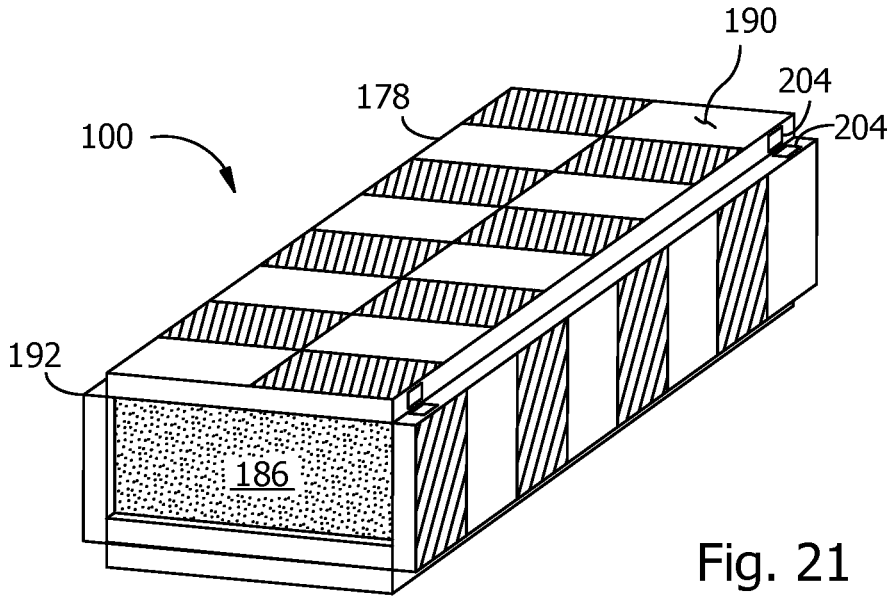
Fig. 21

CHESS SET WITH INTERMESHING GAME PIECES

FIELD OF THE INVENTION

Embodiments are related to equipment for playing chess and more specifically to game pieces having shapes similar to standard Staunton chess pieces so that the rank of the piece is readily recognizable, configured to mesh into other game pieces for compact storage.

BACKGROUND

Some portable chess sets include very large pieces for use in outdoor settings. These chess sets may include chess pieces that are assembled from flat sections that interlock. This results in large play pieces that differ substantially from the look and feel of chess pieces provided in game sets for tabletop use, but rather provide something which may be described as large tokens representing the various pieces. Each playing piece may include two or more parts that must be assemble and disassembled. With 32 chess pieces this is time consuming and arduous. Scaling such equipment down to a size more convenient for tabletop use leads to many small pieces that may be hard to assemble and which may be easily broken or misplaced.

Other portable chess sets provide containers that hold the pieces for transport and provide a chess playing surface. Such chess sets may fail to provide a small compact package or to reduce the volume required to store the pieces. Because there are 32 chess pieces in a game set, separately storing a complete set either requires a lot of room resulting in a voluminous chess set, or a smaller set with tiny chess pieces.

Yet other chess sets use pieces not having the recognizable three-dimensional shape of chess pieces but rather are flat pieces or tokens or cones all having the same shape but with markings on them to denote the various ranks of pieces. Such pieces also fail to provide the look and feel of ordinary chess pieces.

SUMMARY

An example apparatus embodiment of a chess set includes a set of two or more chess pieces that have overall symmetrical shape, and having three dimensional distinctive shape features denoting the rank of the piece similar to the distinctive shape features denoting the ranks of corresponding piece in common Staunton style chess pieces, and at least two of the pieces are configured so that they can intermesh or combine with one another to result in a combined unit that can be stored in as little as half the space that would be required to store the two pieces if stored separately. The disclosed example embodiments of chess pieces include at least one of the following:

- a chess piece whose shape denotes a knight chess piece by depicting in three dimensions the head and neck of a horse and having an opening near the base of the piece configured to accommodate insertion of the head of another chess piece that depicts in three dimensions the head and neck of a horse;
- a chess piece whose shape denotes a rook chess piece by depicting a castle tower having radial symmetry around a vertical axis and having an opening at the top to an internal cavity configured to accommodate insertion of another chess piece such as a bishop;
- a chess piece whose shape denotes a bishop chess piece having a radial symmetry around a vertical axis generally narrowing from the base to the top and whose shape is configured to fit into the opening at the top of, and the cavity within, another chess piece such as a rook;
- a chess piece whose shape denotes a bishop chess piece having a radial symmetry around a vertical axis generally narrowing from the base to a level partway up its height and then flaring out wider to the base of a generally conical shape and whose overall shape is configured to fit into the opening at the top of, and the cavity within, another chess piece such as a rook;
- a chess piece whose shape denotes a chess piece pawn having radial symmetry around a vertical axis, and a shape narrowing from the base up to a ball-shaped top and having an opening at the bottom to a cavity configured to accommodate insertion of another chess piece such as another pawn;
- a chess piece whose shape denotes a chess piece pawn having radial symmetry around a vertical axis and having two or more vertical members rising from the base configured to accommodate meshing with an inverted chess piece having two or more members rising from its base, such as another pawn;
- a chess piece whose shape denotes a chess piece king having radial symmetry around a vertical axis and having a shape whose diameter narrows from the base to a level partway up its height and then flares out above that level and comprising two or more vertical members rising from its base with separations between them and openings in the base of the piece corresponding to the separations between the vertical members and configured to accommodate insertion of vertical members of another chess piece, such as a queen;
- a chess piece whose shape denotes a chess piece king having radial symmetry around a vertical axis and having a cross at the top and comprising two or more vertical members rising from its base with separations between them and openings in the base of the piece corresponding to the separations between the vertical members and configured to accommodate insertion of vertical members of another chess piece, such as a queen; and
- a chess piece whose shape denotes a chess piece queen having radial symmetry around a vertical axis, and having a shape whose diameter narrows in from the base to a level partway up its height, and then flares out above that level, and comprising two or more vertical members rising from its base configured to fit into the openings in the base of another piece and the separations between the vertical members of that piece, such as a king.

Some embodiments of a chess set include a first chess piece having a base; a first chamfered column attached to the base; and a second chamfered column attached to the base with a channel intervening between the first chamfered column and the second chamfered column. The embodiment of a chess set further includes a second chess piece having a second base formed with a first aperture and a second aperture, the first aperture sized for admittance of the first chamfered column, and the second aperture sized for admittance of the second chamfered column; a central interior column attached to the second base, the central interior column positioned between the first aperture and the second aperture, and the central interior column sized to fit in between the first chamfered column and the second chamfered column; a first outer column attached to the second base and to the central interior column; and a second outer column attached to the second base and to the central interior column, the first outer column positioned to slidably engage in the channel; and a folding chess board.

An embodiment of a chess set optionally includes a third chess piece, the third chess piece including a third base; a third chess piece body attached to the third base; and a transverse member joined to the third chess piece body. The third chess piece body is formed with an aperture sized to receive the transverse member from another of the third chess piece.

An embodiment of a chess set optionally includes a fourth chess piece and a fifth chess piece. The fourth chess piece includes a fourth base and a fourth chess piece body attached to the fourth base. The fifth chess piece includes a fifth base and a fifth chess piece body attached to the fifth base. The fifth chess piece body is formed with a longitudinal void space extending from a top end toward the fifth base. The longitudinal void space is formed with an interior shaped to receive the body of the fourth chess piece.

An embodiment of a chess set optionally includes a sixth chess piece having a sixth base and a sixth chess piece body attached to the sixth base. The sixth chess piece body is formed with at least two longitudinal members attached to the base with spaces intervening between them and configured so that the longitudinal members fit into the spaces between the longitudinal members of another of the sixth chess piece when that piece is inverted.

BRIEF DESCRIPTION OF THE DRAWINGS

FIG. 9 is a top view of the example of the rook of FIG. 1 and FIG. 2.

FIG. 10 is a side view of the example of a rook of FIGS. 1, 2, and 9.

FIG. 11 is a cross-sectional view A-A showing an aperture formed in the rook for receiving the bishop of the previous figures. A location and viewing direction for section A-A is marked with a section line A-A in FIG. 9.

FIG. 20 is a pictorial view of example of the folding chess board of FIGS. 18-19, showing the chess board in a partially-folded configuration.

FIG. 21 shows the folding chess board of FIGS. 18-20 folded around an example of a game piece storage container for holding a complete chess set stored as the intermeshed chess pieces of FIG. 2.

DESCRIPTION

The disclosed example apparatus embodiments provide chess pieces that intermesh in a way that the volume needed to store the pieces is reduced to as little as half what would have been required if the pieces are stored separately, yet are full size, three-dimensional pieces with distinctive designs reflecting the recognizable shapes and contours of standard chess pieces, having the look and feel of ordinary chess pieces such as the weight and stability of their solid bases.

This is accomplished by having the major pieces—the king, queen, rook, bishop and knight—designed so that they can be intermeshed pairwise to save storage space. In addition, the pawns can be stacked or meshed together, again saving storage space. The pieces can then be stored in a compact storage container. The board is jointed and can wrap around the storage container, resulting in a compact portable set with full sized pieces having the form similar to standard chess pieces.

The disclosed embodiments of a chess set provides full size chess pieces with symmetrical shape and contour denoting the rank of the piece, and which mesh together pairwise for compact storage in a portable set. Along with the volume reduction achieved by the meshed pairs of chess pieces, there is optionally a full-size folding chess board unlike those in previously available chess sets. The board is jointed and can wrap around the storage container holding the intermeshed pieces. The folding chess board and the meshing pieces result in a very compact portable chess set that does not compromise on the size of the playing surface or the satisfactory size of the chess pieces.

Figure 1:
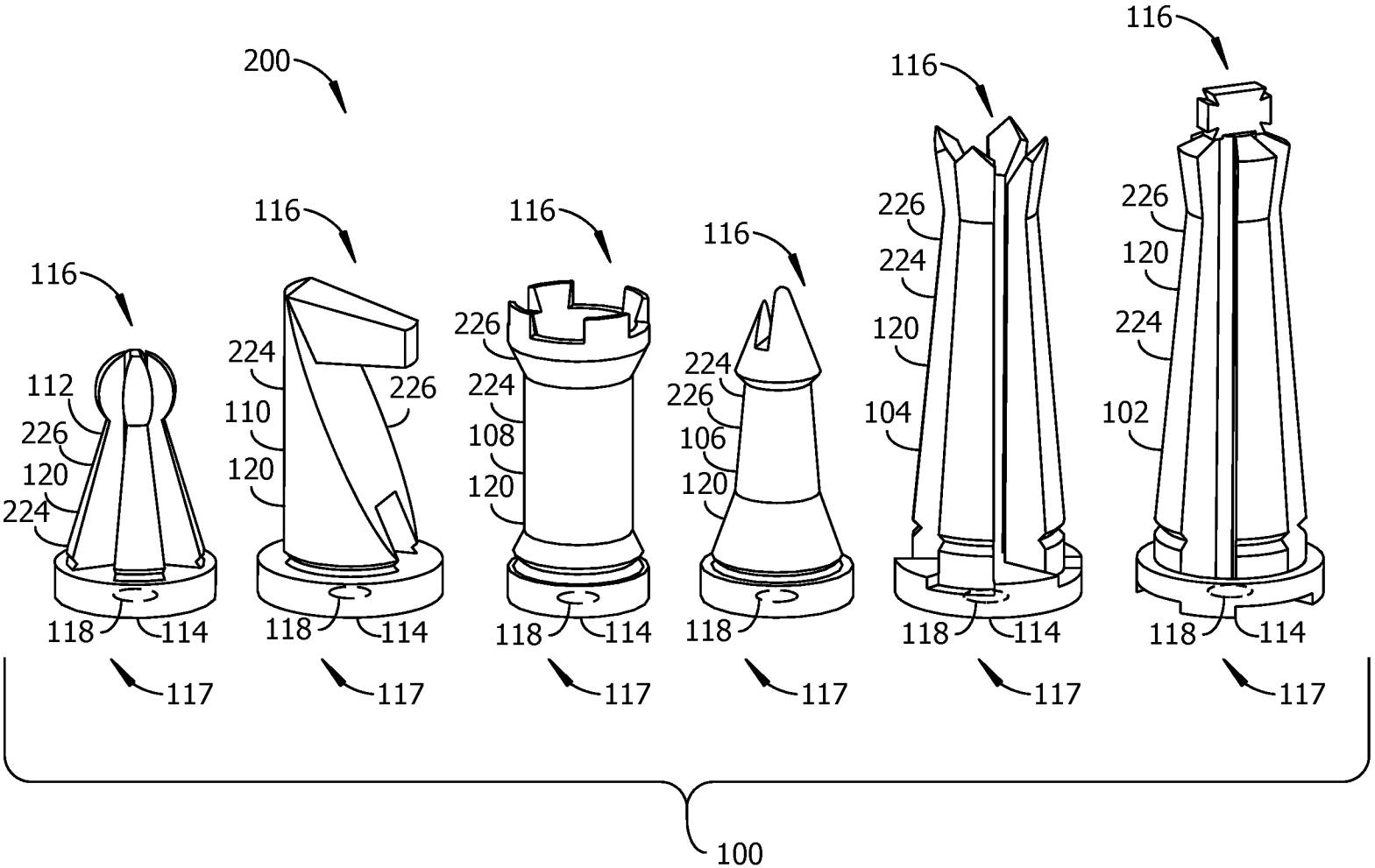
FIG. 1 is a pictorial view of examples of chess pieces in accord with the disclosed embodiments, including from left to right a pawn, a knight, a rook, a bishop, a queen, and a king.

FIG. 1 shows an example preferred embodiment of the Staunton-style chess pieces 200, including a first chess piece corresponding to a queen 104, a second chess piece corresponding to a king 102, a third chess piece corresponding to a knight 110, a fourth chess piece corresponding to a bishop 106, a fifth chess piece corresponding to a rook 108, and a sixth chess piece corresponding to a pawn 112, together representing the different types of chess pieces included in a set of game pieces for playing a game of chess. Each of the chess pieces in an embodiment 100 of a chess set includes a base 114 at a bottom end 117, a chess piece body 224 which may have a part referred to as a longitudinal member 226, at least one column 120, a top end 116, and an optional magnet 118 in the base to hold the chess piece against a chess board having ferrous or magnetic components. At the start of a chess game, each chess piece may be positioned on a square on a chess board with the bottom end 117 of the base 114 in contact with the top surface of the chess board.

Figure 2:
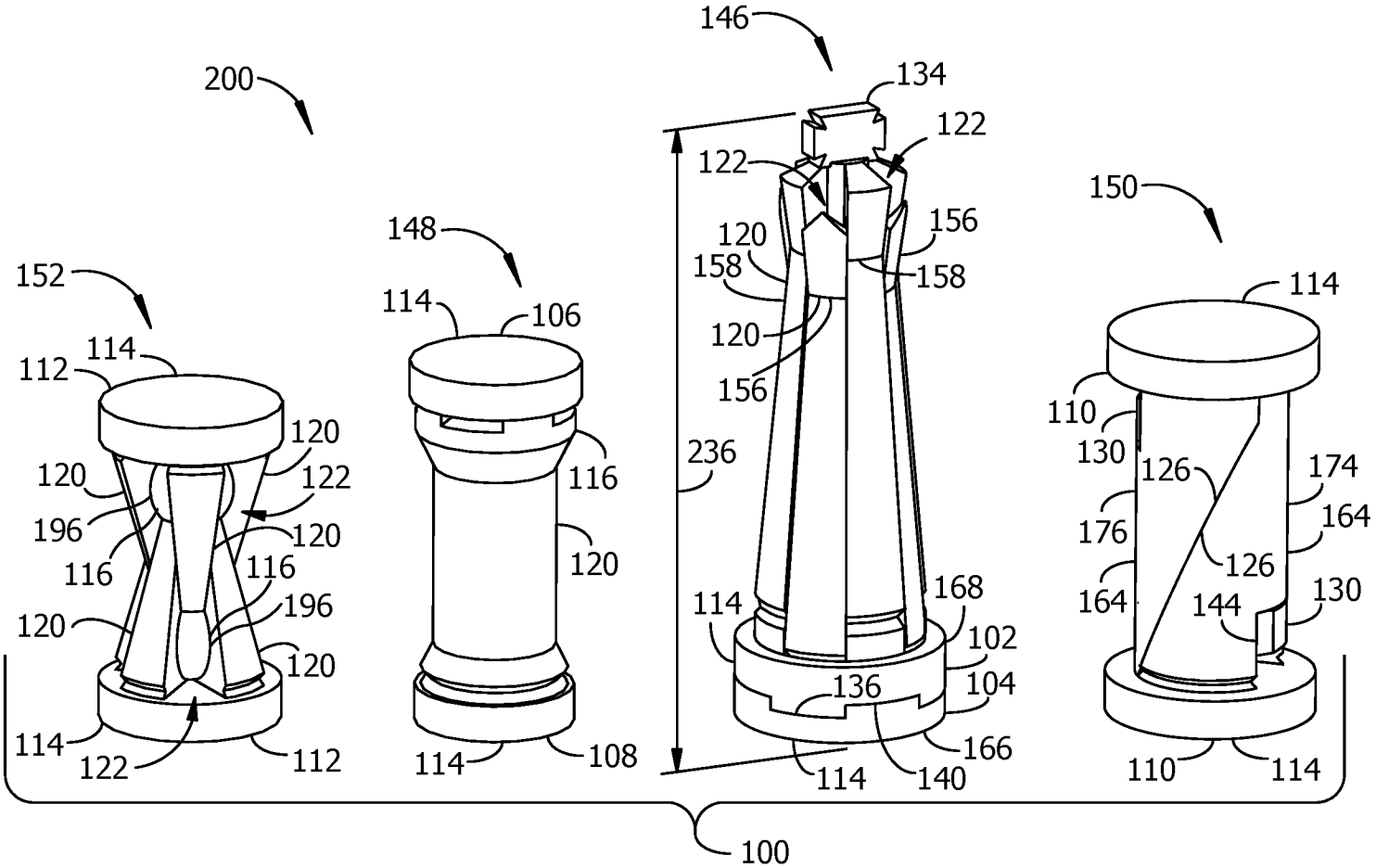
FIG. 2 is a pictorial view of the examples of chess pieces of FIG. 1 with the chess pieces intermeshed for storage, including two pawns meshed with one another, the bishop meshed with the rook, the queen and the king meshed with one another, and two knights meshed with one another.

As suggested in FIG. 2, the chess pieces may be intermeshed with one another to save space. Intermeshed pieces may also be referred to as meshed pairs, combined units, and/or chess-piece-combinations. For example, the king 102 and queen 104 may be meshed with one another to form a first meshed pair 146. Chamfered columns 156 extending upward from the base 166 of the queen pass through apertures 170 formed in a base 168 of the king and enter into channels 122 between outer columns 158 extending upward from the base of the king, with the base 166 of the queen positioned against the base 168 of the king to form the first meshed pair 146. Each of the meshed pairs 152, 148, 146, and 150 are designed to reduce the space required for storage of the meshed pair to less than 65% of the space that would have been required to store the pieces of the pair separately.

Continuing with the examples of meshed pairs in FIG. 2, parts of the bishop 106 extending from the bishop's base 114 may be placed inside an aperture formed in the rook 108 to form a second meshed pair 148. To form the second meshed pair, the bishop is inverted relative to the rook and the top end 116 of the bishop inserted into an aperture formed in the top end 116 of the rook. Interior details of the rook will be described later with regard to FIGS. 9-11.

A third meshed pair 150 may be formed from two knights 110. Each knight includes a structure representing a head and neck of a horse 208 with a nose end 130 projecting transversely from the top end 116 of an angle-faced column 164 attached to a base 114. The angle-faced column 164 on each knight 110 is formed with an angled face 126 and a transverse aperture 144 near the base 114. The third meshed pair 150 includes a first knight 174 and a second knight 176 inverted relative to the first knight. The nose end 130 of each knight is inserted into the transverse aperture 144 of the other member of the meshed pair until an angled face 126 on the first knight rests against the angled face 126 of the second knight.

Two pawns 112 may be meshed with one another to form a fourth meshed pair 152. Each pawn includes two or more columns 120 extending away from a base 114. A column 120 of a pawn may also be referred to as a vertical member 210 of the pawn. A segment of a spheroid 196 formed at the top end 116 of each column establishes the appearance of the ball-shaped upper end of a Staunton-styled pawn. To form the fourth meshed pair 152, columns 120 on a pawn 112 are positioned in channels 122 between columns 120 on an inverted pawn 112, with the base 114 of the first pawn and the base 114 of the second pawn at opposite ends of the meshed pair 152 and a top end 116 of each pawn adjacent the base of the adjacent pawn.

Pieces engaged with one another to reduce storage space may be referred to herein as meshed pieces or as intermeshed pieces. As suggested in the figures, each chess piece embodiment is formed as a single, integral part, with no assembly needed after initial manufacture and no readily detachable components.

Figure 3:
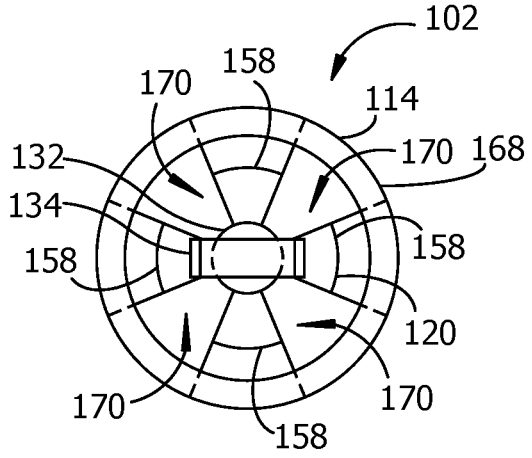
FIG. 3 is a top view of the example of the king of FIG. 1 and FIG. 2.

FIGS. 3-15 present additional features of the chess pieces from the examples of FIG. 1 and FIG. 2. The example of a king 102 in FIG. 3 and FIG. 4 includes at least two, and in the illustrated example, four outer columns 158 extending upward from a base 168. An outer column 158 may also be referred to as a vertical member 212 of the king. The outer columns 158 are joined to a central interior column 132. A cross 134 attached to the top end 116 of the central interior column 132 identifies the rank of the chess piece as a king. The profile shape of the outer columns and the cross are in accord with Staunton style for a king chess piece. Channels 122 formed by spaces between the outer columns 158 are sized to receive the chamfered columns 156 on the queen. Each channel 122 extends through the base 114 of the king at an aperture 170. The example of a king is formed with radial symmetry around a vertical axis and includes a shape whose diameter narrows from the base of the king 168 to a level 218 partway up a height 216 of the king and then flares out above the level 218.

Figure 5:
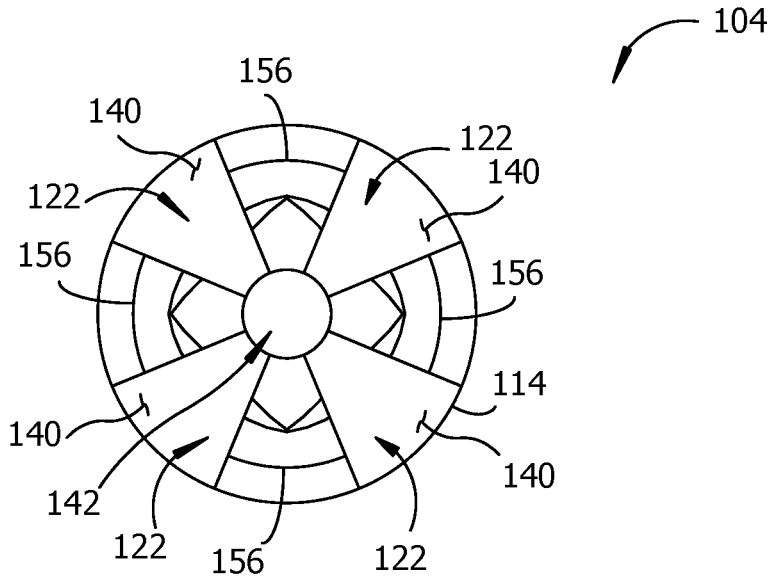
FIG. 5 is a top view of the example of the queen of FIG. 1 and FIG. 2.
Figure 6:
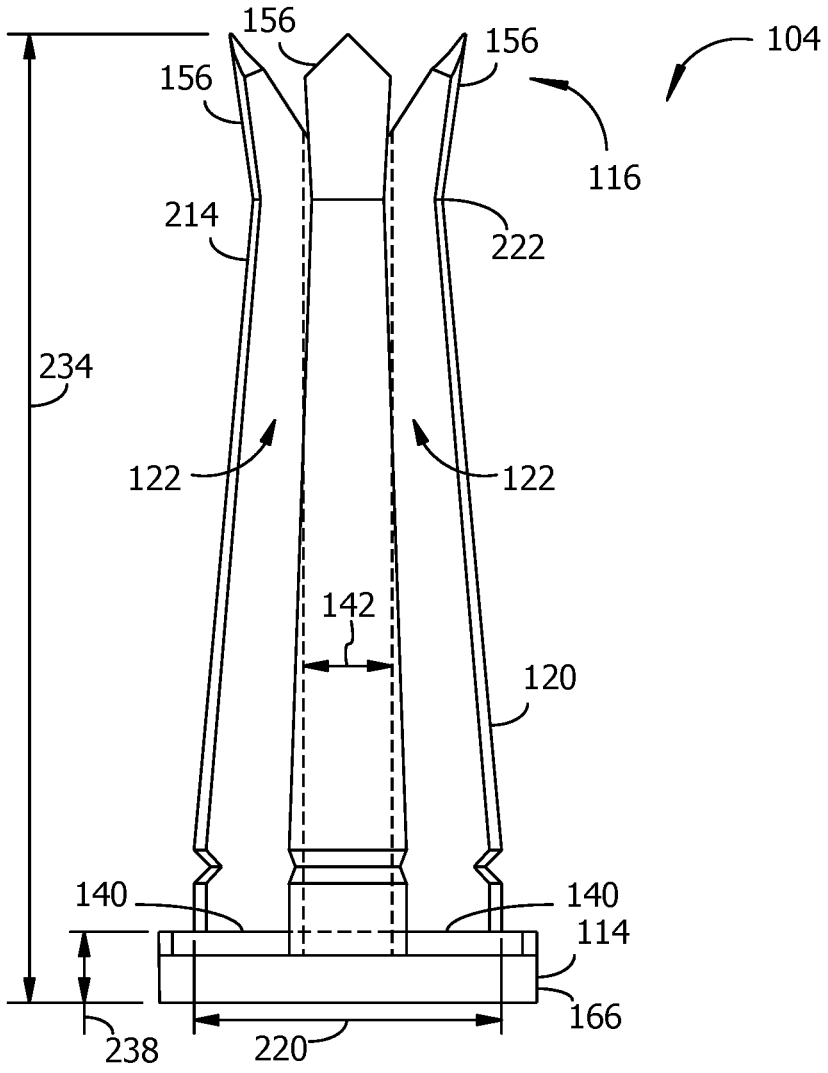
FIG. 6 is a side view of the example of the queen of FIGS. 1, 2, and 5.

The example of a queen 104 in FIG. 5 and FIG. 6 includes at least two, and in the illustrated example, four chamfered columns 156 extending upward from a base 166. The chamfered columns together form a chess piece body 224 having a diameter 220 near the base of the queen. The diameter 220 narrows from the base of the queen to a level 222 partway up the height of the queen. A chamfered column 156 may also be referred to as a vertical member 214 of the queen. The chamfered columns 156 are separated from one another by channels 122 and a central aperture 142. The top ends of the chamfered columns 156 narrow to an apex and flare outward to present the appearance of the crown of the queen chess piece in accord with Staunton style. The channels and central aperture extend from the top side of the base 166 to the top end 116. Optional pads 140 extending upward from a top side of the base 166 between adjacent chamfered columns 156 on the queen are positioned to engage in corresponding void spaces formed between feet 136 extending downward from a bottom side of the base 168 of the king 102. As suggested in the example of FIG. 2, the top ends of the chamfered columns 156 on the queen may be passed through the apertures 170 in the base 168 of the king to form the first meshed pair of game pieces 146.

Figure 4:
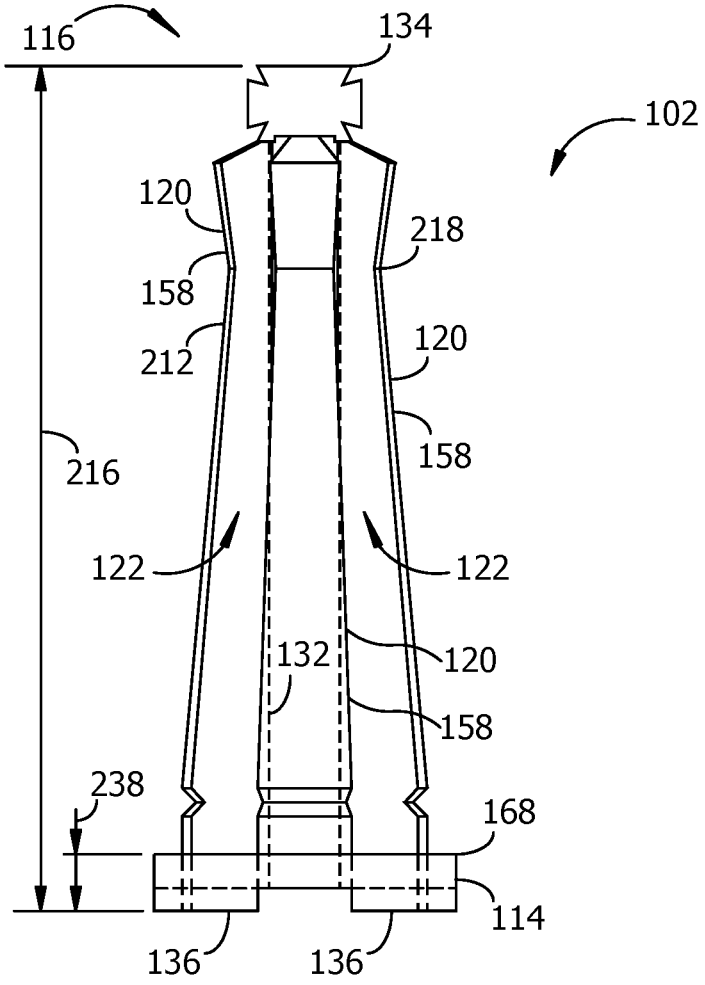
FIG. 4 is a side view of the example of the king of FIGS. 1-3.

FIGS. 2, 4, and 6 illustrate an example of space savings achieved by the disclosed embodiments of chess pieces. As previously described, each of the meshed pairs 152, 148, 146, and 150 are configured to reduce the space required for storage of a meshed pair to less than 65% of the space needed to store the members of the pair separated from one another. An example of the height 216 of a king 102 and an example of the thickness 238 of a base 114 of a chess piece are shown in FIG. 4. An example of the height 234 of a queen 104 is shown in FIG. 6, and an example of the height 236 of a meshed pair is shown in FIG. 2. The height 236 of the meshed pair corresponds to the height 216 of the king plus the thickness of the base of the meshed chess piece, i.e., the thickness 238 of the base of the queen. The height 236 of the meshed pair is less than or equal to 65% of the sum of the height 216 of the king and height 234 of the queen, a reduction in storage space that applies to all the meshed pairs disclosed herein. To a first approximation, a storage space needed for an individual chess piece may be estimated as an area of the bottom end of the base of the piece, ignoring the areas of any apertures through the base, multiplied by a height of the piece. The space required to store a meshed pair is therefore no more than 65% of the summed spaces for storing the individual pieces forming the meshed pair.

Figure 7:
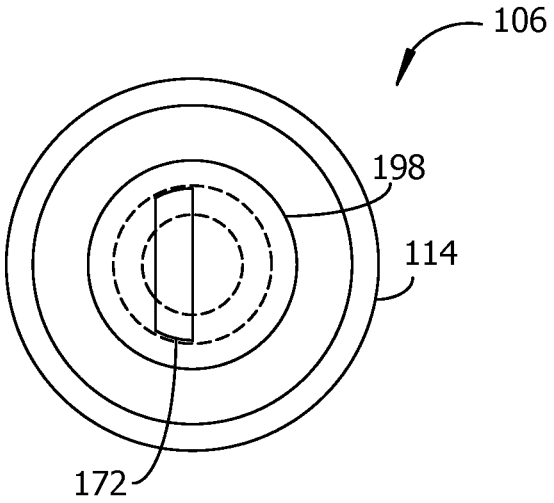
FIG. 7 is a top view of the example of the bishop of FIG. 1 and FIG. 2.
Figure 8:
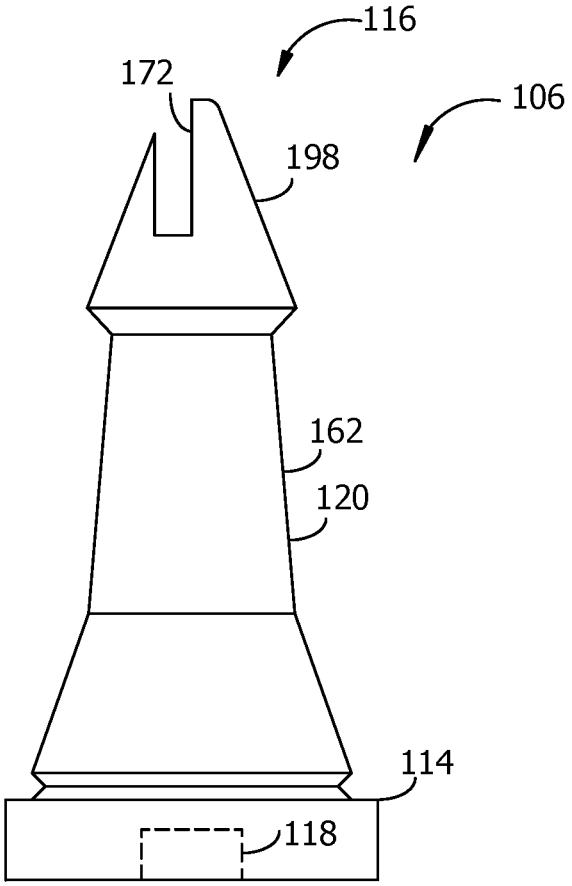
FIG. 8 is a side view of the example the bishop of FIGS. 1, 2, and 7.

As shown in the examples of FIG. 7 and FIG. 8, the bishop 106 from the examples of FIG. 1 and FIG. 2 is formed with a tapered upper end 198 joined to a column 162. The column 162 is joined to a base 114. A transverse slot 172 formed in the tapered upper end 198 identifies the rank of the chess piece as a bishop in accord with Staunton style.

Some details of the example rook 108 from FIG. 1 and FIG. 2 are shown in FIGS. 9-11. A hollow column 160 extends upwards from a base 114. The top end 116 of the hollow column 160 is crenellated in accord with Staunton style for a rook, representing a castle tower 232. A tapered aperture 124 extends from the top end 116 toward the base 114. The tapered aperture is shaped to receive the upper parts of a bishop 106 with a sliding fit.

FIGS. 9-10 further illustrate examples of a vertical axis 230 passing through a center 228 of the circular bottom face of the base 114. All of the example chess pieces of FIG. 1 have a vertical axis 230 passing through the center 228 of the base of each piece as shown in the examples of FIGS. 9-10. Each of the example chess pieces of FIG. 1 except the knight 110 possess radial symmetry about the vertical axis 230, that is, each chess piece includes elements repeated at equal angular intervals around the vertical axis of the piece.

Figure 12:
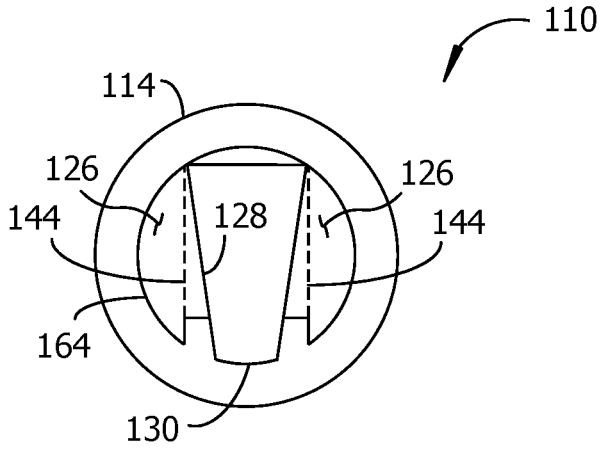
FIG. 12 is a top view of the example of the knight from FIG. 1 and FIG. 2.
Figure 13:
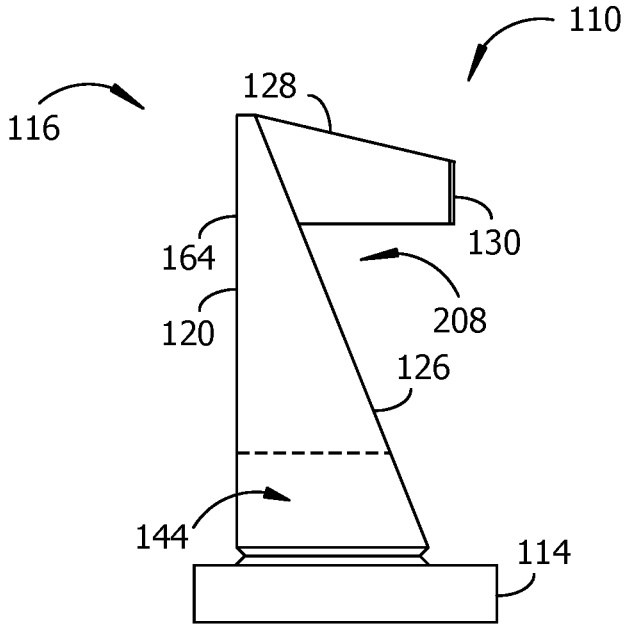
FIG. 13 is a side view of the example of the knight from FIGS. 1, 2, and 12.
Figure 14:
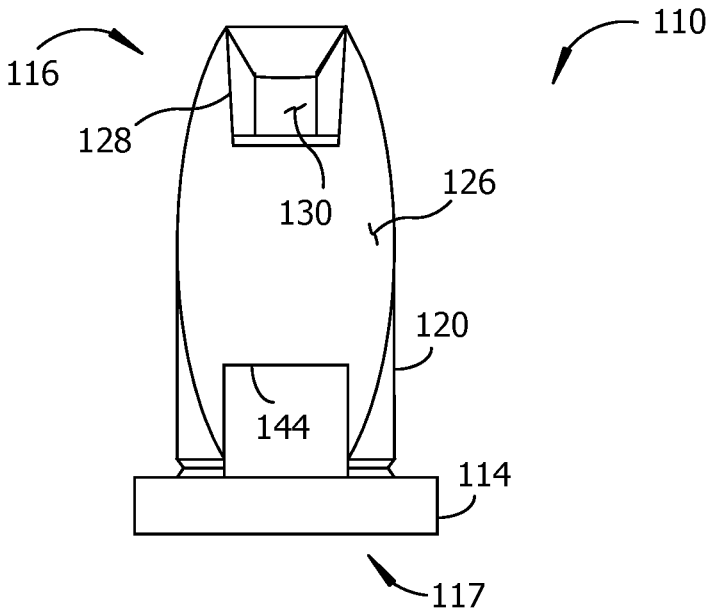
FIG. 14 is a view toward the nose end of the head on the example of the knight from the preceding figures.

Some details of the example knight 110 from FIG. 1 and FIG. 2 are shown in FIGS. 12-14. As in a traditional Staunton chess set the knight 110 is depicted by structures representing the neck and head of a horse. The example knight 110 is formed with an angle-faced column 164 extending upward from a base 114. The angle-faced column 164 is formed with an angled face 126 extending from near the base to the top end 116 of the knight. A transverse projection 128 extends outward from the angled face 126 at the top end and terminates in a nose end 130, representing the head of a horse in accord with Staunton style. A transverse aperture 144 passing through the angle-faced column 164 is shaped to receive the transverse projection 128 of another knight with a sliding fit.

Figure 15:
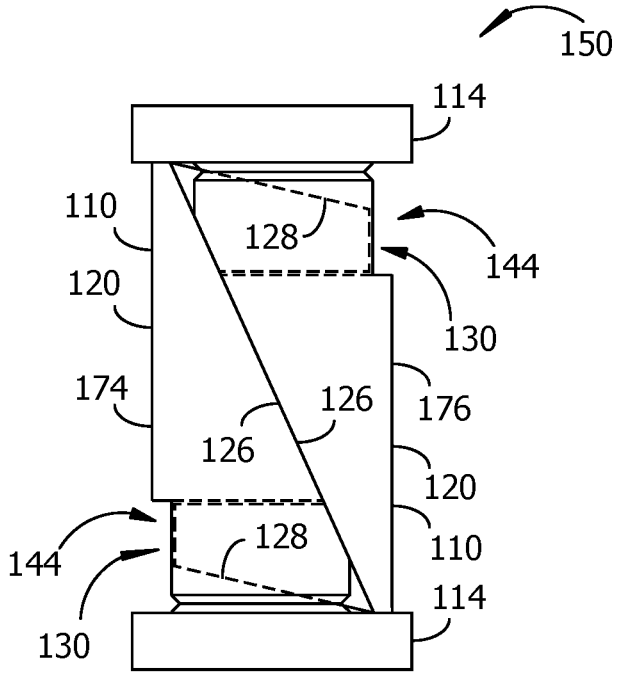
FIG. 15 is a side view of two knights meshed with one another for compact storage.

FIG. 15 shows a side view of the third meshed pair of game pieces from FIG. 2. A first knight 174 is shown with its base 114 facing downward. A second knight 176 is shown with its base 114 at the top of the meshed pair. The head 128 and the nose end 130 of the first knight 174 is shown in position in the transverse aperture 144 of the second knight 176, and the head and nose end of the second knight 176 is shown in position in the transverse aperture 144 of the first knight 174. The angled face 126 of the first knight is in contact with the angled face 126 of the second knight in the illustrated example.

Figure 16:
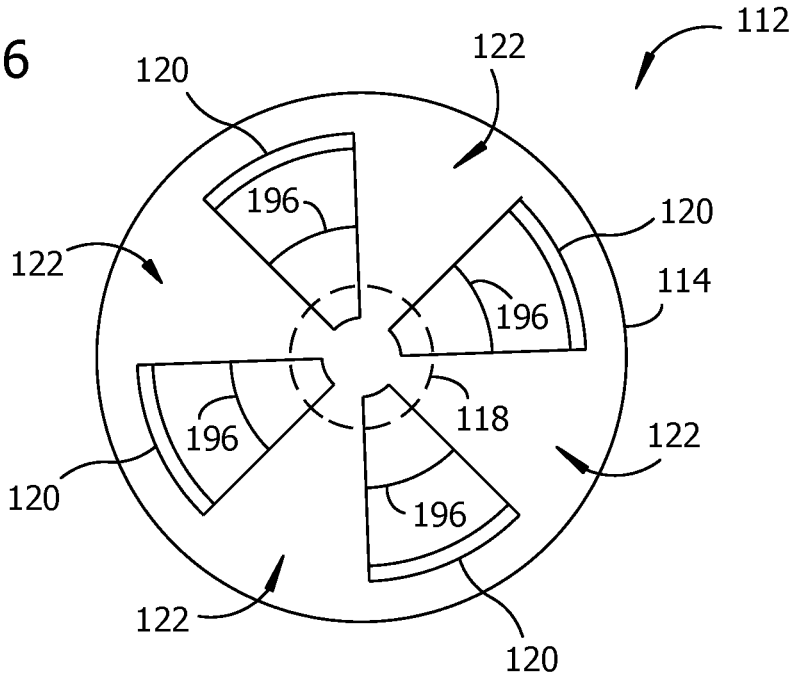
FIG. 16 is a top view of the example of the pawn from FIG. 1 and FIG. 2.
Figure 17:
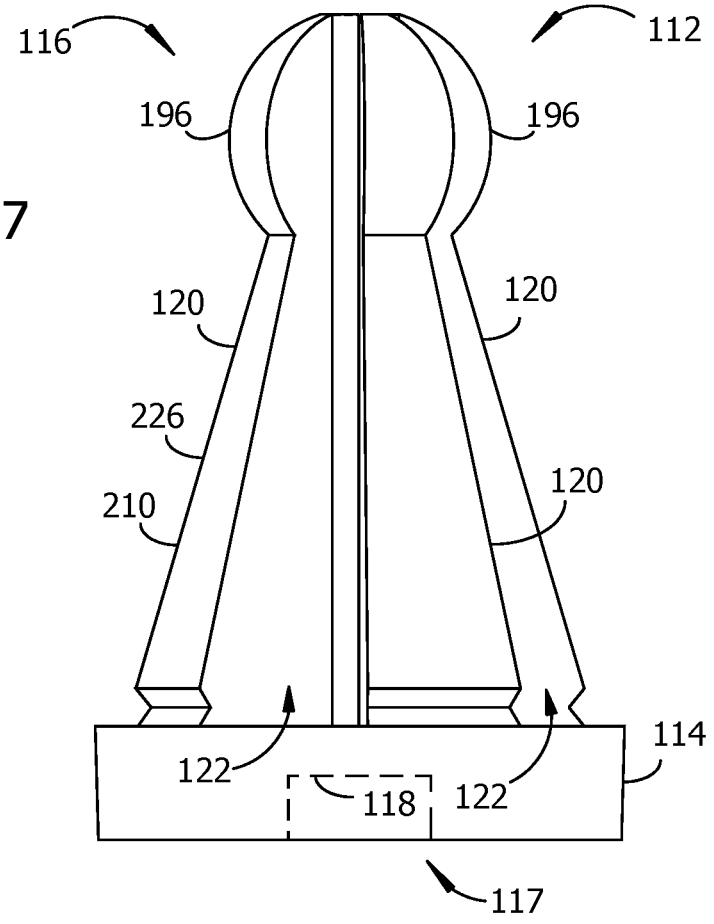
FIG. 17 is a side view of the example of the pawn from FIGS. 1, 2, and 16.

Some details of the example pawn 112 from FIG. 1 and FIG. 2 are shown in FIGS. 16-17. The example of a pawn 112 includes at least two, and in the illustrated example, four columns 120 extending upward from the base 114. Each column has attached at its upper end 116 a sector of a spheroid 196. The columns are separated from one another by intervening channels 122.

Figure 18:
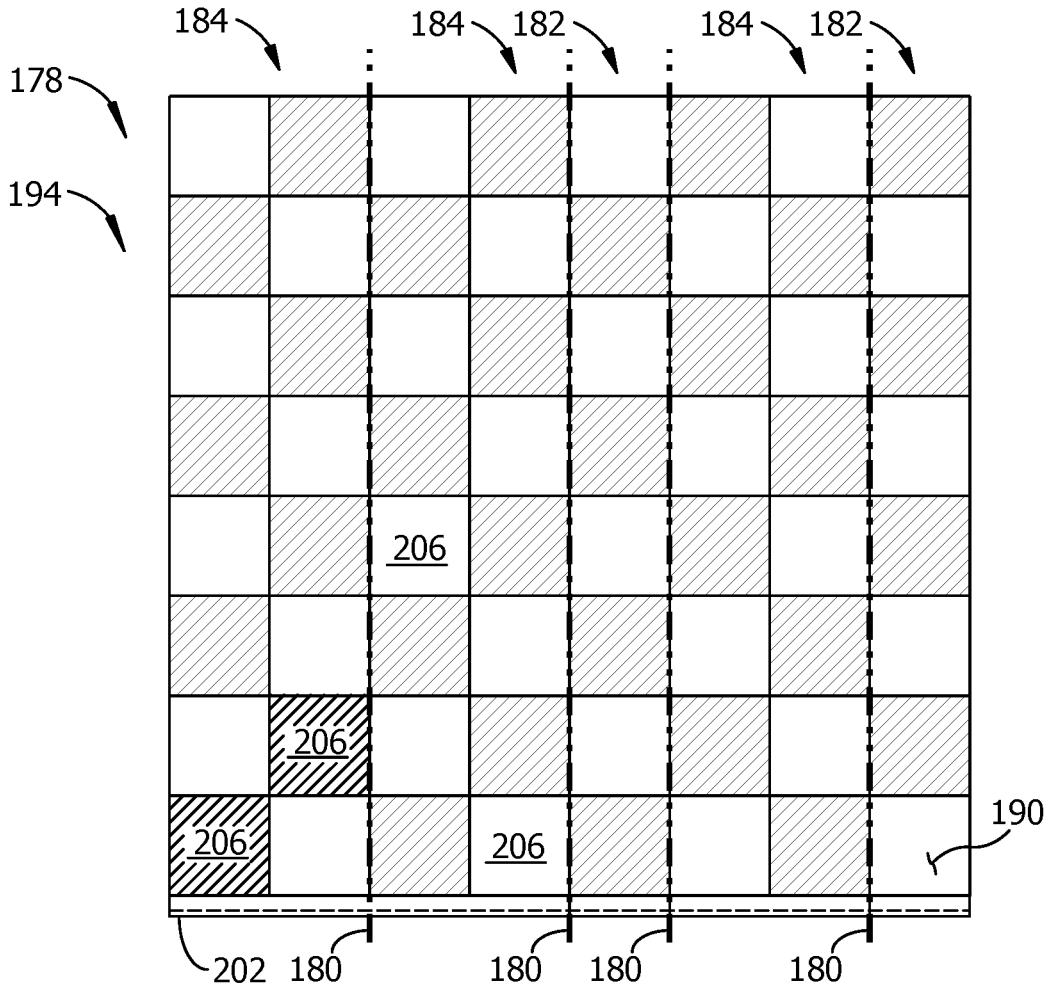
FIG. 18 is a view toward the top surface of an example of a folding chess board optionally included in some embodiments of a chess set, with the chess board fully unfolded to form a flat playing surface including eight rows and eight columns of squares of alternating light and dark colors.
Figure 19:
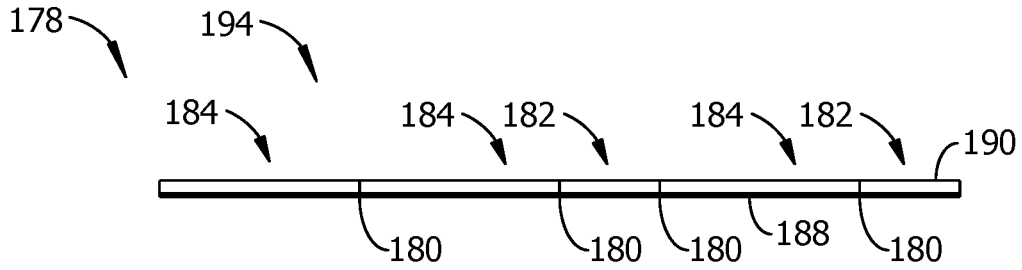
FIG. 19 is a side view of the example of a folding chess board of FIG. 18.

FIGS. 18-22 show examples of an optional folding chess board 178 configured to enclose a game piece storage container 186 included with some embodiments of a chess set 100. The top surface 190 of the folding chess board is marked with eight rows and eight columns of light-colored squares 206 and dark-colored squares 206 in an alternating pattern. FIG. 18 and FIG. 19 show an example of the folding chess board in a fully-unfolded configuration 194 with an approximately planar top surface 190. As suggested in FIG. 18 and FIG. 19, the folding chess board includes a first 1-square-wide panel 182 rotatably connected to a first 2-square-wide panel 184 along a first fold line 180. A second 1-square-wide panel 182 is rotatably connected to the first 2-square-wide panel 184 along a second fold line 180 on a side opposite the first fold line. A second 2-square-wide panel 184 is rotatably connected to the second 1-square-wide panel along a third fold line 180 on a side opposite the second fold line. A third 2-square-wide panel 184 is rotatably connected to the second 2-square-wide panel along a fourth fold line 180 on a side opposite the third fold line. The two 1-square-wide panels 182 and the three 2-square-wide panels 184 may be rotatably connected to one another by a flexible backing sheet 188 or by hinges.

An optional, removable edge stiffener 202 formed as a C- or U-shaped extrusion made from a rigid material may be attached to an edge of the chess board to hold the folding board flat. Alternatively, magnets 204 may be attached along the edges of the chess board to hold the chess board flat. Examples of magnets 204 are shown in FIG. 21.

FIG. 20 shows an example folded configuration 192 of the folding chess board 178, with the panels rotated relative to one another along the four fold lines 180 and the top surface 190 indicated by the pattern of squares 206. FIG. 21 shows another example folded configuration 192 with the folding chess board enclosing a game piece storage container 186, with the outer edges of the game piece storage container in contact with the bottom side of the folding chess board. The hollow structure formed by the folding chess board may be referred to as a hollow open ended, rectangular hexahedron. As suggested in the example of FIG. 21, the folded chess board forms a storage compartment to store the meshed pairs of chess pieces inside this hollow hexahedron, resulting in the compact portable chess set.

Figure 22:
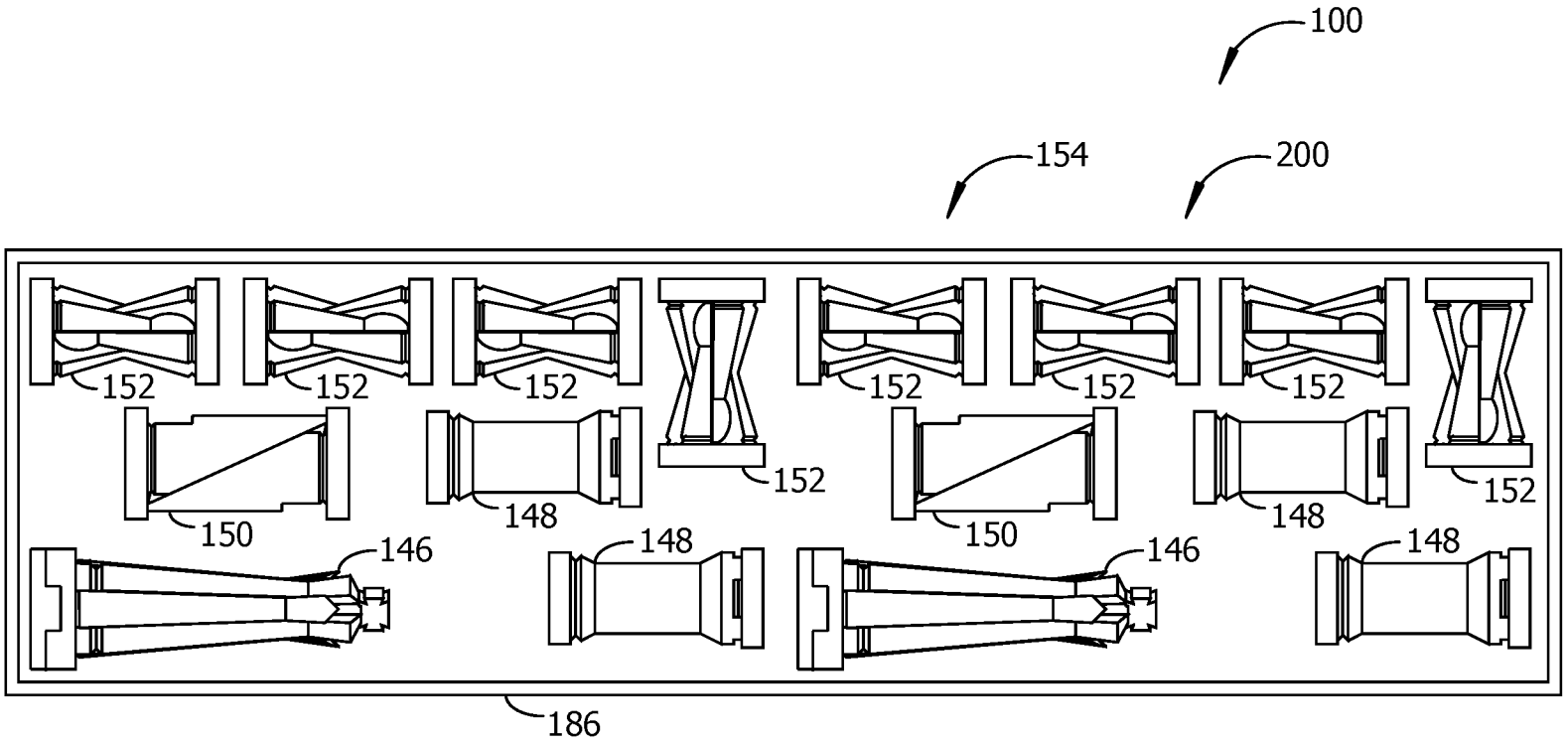
FIG. 22 shows a top view of the storage container of FIG. 21, illustrating one of many possible alternative arrangements for storing the intermeshed chess pieces included in a complete set of game pieces for playing a game of chess.

FIG. 22 shows an example of a complete set of chess pieces 154 represented by two of the first meshed pair 146 (king 102 and queen 104), four of the second meshed pair 148 (rook 108 and bishop 106), two of the third meshed pair 150 (knight 110 and knight 110), and eight of the fourth meshed pair 152 (pawn 112 and pawn 112). The positioning of meshed pairs in FIG. 22 is one of many acceptable alternative arrangements. As suggested in FIG. 22, a complete chess set 154 with individual pieces formed in accord with Staunton style 200 and having sizes in accord with rules for tournament play may be securely stored in a volume enclosed by the chess board upon which the pieces will be set for game play.

The example disclosed embodiments include a set of two or more chess pieces that have the recognizable 3-dimensional shape and silhouette and approximately the same heft as standard Staunton chess pieces of the same rank, height and base diameter, and designed such that at least two of the pieces are configured so that they can intermesh or combine with one another to result in a combined unit that can be stored in approximately half the space that would be required to store the two pieces if stored separately, or approximately half the space required to store the corresponding standard Staunton chess pieces of the same rank, height and base diameter.

All of the pieces except the knight, optionally have radial symmetry around a vertical axis through the center of the piece. At least two of the pieces each have the rank of one of the group of pieces consisting of the major pieces—that is, the king, queen, bishop, knight and rook. In some embodiments, an example piece A of rank A includes a central shaft with radiating arms that have an outer contour that is similar to the contour of a standard chess piece of rank A so piece A is readily recognized as having rank A, and the other, piece B of rank B, has a central hole and radiating arms that have an outer contour that is similar to the contour of a standard chess piece of rank B so piece B is readily recognized as having rank B, wherein the central shaft and radiating arms of piece A mesh into the central hole and radiating arms of piece B, to result in a combined unit that can be stored in approximately half the space that would be required to store the two pieces if stored separately, or approximately half the space required to store the corresponding standard Staunton chess pieces of the same rank, height and base diameter.

Piece A may be the king and piece B may the queen. Alternately, piece A is the queen and piece B is the king. The two pieces A and B optionally intermesh such that the tops of the two pieces are adjacent in the combined unit, and the bottoms of the two pieces are adjacent in the combined unit.

For some meshed example pieces, one piece may be inverted with respect to the other in the combined unit, whereby the top of each piece is adjacent to the bottom of the other piece in the combined unit.

For some meshed example pieces, for example a piece C has a solid substantially conical shape, and a piece D has a central void space with an aperture at the top designed to receive piece C, to result in a combined unit that can be stored in approximately half the space that would be required to store the two pieces if stored separately, or approximately half the space required to store the corresponding standard Staunton chess pieces of the same rank, height and base diameter. In some example embodiments, piece C is a bishop and the piece D is a rook.

For some example embodiments, each of the major pieces (king, queen, bishop, knight, rook) is designed so that it each can be meshed with another of the major pieces, to result in combined units that can be stored in approximately half the space that would be required to store the two pieces if stored separately, or approximately half the space required to store the corresponding standard Staunton chess pieces of the same rank, height and base diameter.

In an embodiment including a sufficient number of chess pieces to play a game of chess according to commonly accepted rules of the game, eight of the pieces represent pawns that can be intermeshed with one another into a combined unit that can be stored in approximately half the space required by the eight pawns if stored separately or approximately half the space required to store eight standard Staunton chess pawns of the same height and diameter.

Two of the pieces that can be meshed together may both have the same rank representing the same standard Staunton chess piece and are designed such that they can be intermeshed when one can piece is inverted with respect to the other to result in a combined unit that can be stored in approximately half the space that would be required to store the two pieces if stored separately, or approximately half the space required to store the corresponding standard Staunton chess pieces of the same rank, height and base diameter.

The two pieces having the same rank that can be meshed together when one inverted with respect to the other may each represent the knight in some embodiments.

An embodiment optionally includes a chess piece container for storage of meshed chess pieces such that the container requires approximately half the space to store the eight major chess pieces for one player than would be required to store the eight major pieces for one player separately. The chess container may optionally provide more than one compartment. A folding chess board optionally provides a removable outer surface of the chess piece container.

The folding chess board is optionally configured to fold into the shape of an open-ended rectangular hexahedron.

The chess board may be used for playing a game other than chess.

The optional chess board may be flexibly hinged in at least three locations to permit the board to fold into an open-ended rectangular hexahedron. In some example embodiments, the optional chess board is flexibly hinged between rows one and two, between rows four and five, and between rows seven and eight of the chess board to permit it to fold into an open-ended rectangular hexahedron. Alternatively, the chess board may be flexibly hinged between rows two and three, between rows four and five, between rows five and six, and between rows seven and eight, of the chess board to permit it to fold into an open-ended rectangular hexahedron.

An example method embodiment for storing a set of chess pieces includes forming a first meshed pair by inserting a chamfered column of a queen through an aperture in a base of a king and moving a base of the queen into contact with the base of the king; forming a second meshed pair by inverting a bishop relative to a rook, inserting a tapered end of the bishop into an aperture formed in a top end of the rook, and moving a base of the bishop into contact with the top end of the rook; forming a third meshed pair by inverting a first knight relative to a second knight and sliding a transverse projection of the first knight into a transverse channel formed near a base of the second knight; and forming a fourth meshed pair by inverting a first pawn relative to a second pawn and inserting a column having an end shaped as a spheroidal segment from the first pawn into a channel between two adjacent columns of the second pawn.

What is claimed is:

1. A set of chess pieces comprising at least two chess pieces wherein each of the at least two chess pieces has a chess piece rank and has a rank-identifying shape and further configured such that the at least two chess pieces can be combined into a combined unit, the at least two chess pieces comprise a knight chess piece having a first head portion configured to depict a head of a horse, and a neck portion configured to depict a neck of the horse and attached to the first head portion, and a second chess piece having a second head portion configured to depict the head of the horse, and the knight chess piece having an aperture in the neck portion configured to accommodate insertion of at least a part of the second head portion of the second chess piece.

2. The set of chess pieces of claim 1, wherein the rank-identifying shape of each of the at-least two chess pieces corresponds to a common Staunton-style chess piece having the rank-identifying shape, and the at least two chess pieces are configured to intermesh with one another to form a meshed pair that can be stored in less than 65% of the space that would be required to store the two pieces when stored separately.

3. A set of chess pieces comprising at least two chess pieces wherein each of the at least two chess pieces has a chess piece rank and has a rank-identifying shape and further configured such that the at least two chess pieces can be combined into a combined unit, and wherein the at least two chess pieces comprise a king chess piece configured to depict a common chess king and having a vertical axis and having a first base and a first vertical member and a second vertical member each attached to the first base and having separations between them, the first base is configured with apertures aligned with the separations between the first vertical member and the second vertical member, and a queen chess piece configured to depict a common chess piece queen and having a vertical axis and having a second base and having a third vertical member and a fourth vertical member each attached to the second base; wherein the apertures in the first base are configured to accommodate insertion of the third vertical member and fourth vertical member; and the third vertical member and fourth vertical member are configured to fit into the apertures in the first base and fit into the separations between the first vertical member and the second vertical member.

4. A set of chess pieces comprising at least two chess pieces wherein each of the at least two chess pieces has a chess piece rank and has a rank-identifying shape and further configured such that the at least two chess pieces can be combined into a combined unit, and wherein the at least two chess pieces comprise a first chess piece having a first base and having a first vertical member and a second vertical member each vertical member attached to the first base and having separations between them; and a second chess piece having a second base and having a third vertical member and a fourth vertical member each vertical member attached to the second base and having separations between them; the chess pieces being configured such that the first chess piece and second chess piece can be combined by inserting the first vertical member and the second vertical member into the separations between the third vertical member and the fourth vertical member.

5. A set of chess pieces comprising at least two chess pieces wherein each of the at least two chess pieces has a chess piece rank and has a rank-identifying shape and further configured such that the at least two chess pieces can be combined into a combined unit, and having two chess-piece-combinations selected from a group consisting of the following chess-piece-combinations:

a first chess piece having a first base and a first vertical member and a second vertical member each attached to the first base and having separations between them, the first base is configured with apertures aligned with the separations between the first vertical member and the second vertical member, and a second chess piece having a second base and having a third vertical member and a fourth vertical member each attached to the second base; wherein the apertures in the first base are configured to accommodate insertion of the third vertical member and fourth vertical member; and the third vertical member and fourth vertical member are configured to fit into the apertures in the first base and fit into the separations between the first vertical member and the second vertical member;

a third chess piece having a third bottom end on which the third chess piece sits when used to play chess, and a third top end opposite the third bottom end; and a fourth chess piece having a fourth bottom end on which the fourth chess piece would sit when used to play chess and a fourth top end opposite the fourth bottom end and an upper portion at the fourth top end; the third chess piece further having an aperture at the third top end and extending toward the third bottom end and configured to accommodate insertion of the upper portion of the fourth chess piece; and the fourth chess piece configured such that its upper portion fits into the aperture of the third chess piece;

a fifth chess piece having a fifth base and having a fifth vertical member and a sixth vertical member, the fifth vertical member and the sixth vertical member each attached to the fifth base and having separations between them; and a sixth chess piece having a sixth base and having a seventh vertical member and an eighth vertical member, the seventh vertical member and the eighth vertical member each attached to the sixth base and having separations between them; the fifth chess piece and the sixth chess piece being configured such that the fifth chess piece and sixth chess piece can be combined by inserting the fifth vertical member and the sixth vertical member into the separations between the seventh vertical member and the eighth vertical member; and a seventh chess piece having a first head portion configured to depict the head of a horse, and a neck portion configured to depict the neck of a horse and attached to the first head portion, and an eighth chess piece having a second head portion configured to depict the head of a horse and the seventh chess piece having an aperture in the neck portion configured to accommodate insertion of at least part of the second head portion.

6. A set of chess pieces with a first chess piece and a second chess piece; the first chess piece including a base; a first longitudinal member attached to the base; and a second longitudinal member attached to the base with a space intervening between the first longitudinal member and the second longitudinal member; the second chess piece includes a second base formed with a first aperture and a second aperture, with the first aperture sized for admittance of the first longitudinal member, and the second aperture sized for admittance of the second longitudinal member; and an elongate member attached to the second base, the elongate member positioned between the first aperture and the second aperture, and the elongate member sized to fit in a space between the first longitudinal member and the second longitudinal member when they pass through the first aperture and the second aperture.

7. The set of chess pieces of claim 6, including a third chess piece, the third chess piece including a third base; a third chess piece body attached to the third base; and a transverse member joined to the third chess piece body, wherein the third chess piece body is formed with an aperture sized to receive the transverse member from another of the third chess piece.

8. The set of chess pieces of claim 6, further including a third chess piece and a fourth chess piece, the third chess piece including a third base and a third chess piece body attached to the third base; the fourth chess piece including a fourth base and a fourth chess piece body attached to the fourth base, wherein the fourth chess piece body is formed with a longitudinal void space extending from a top end toward the fourth base, and with the longitudinal void space formed with an interior shaped to accept insertion of the third chess piece body of the third chess piece.

9. The set of chess pieces of claim 6, further comprising a third chess piece, the third chess piece including a third base and a third chess piece body attached to the third base, wherein the third chess piece body is formed with two longitudinal members of the third chess piece attached to the third base with a space intervening between the longitudinal members of the third chess piece, and the longitudinal members of the third chess piece positioned to fit into the space intervening between the longitudinal members of another of the third chess piece.

10. A set of two or more chess pieces configured to engage with one another to form a combined unit with a first chess piece and a second chess piece; the first chess piece including a first base; a first longitudinal member attached to the first base; and a second longitudinal member attached to the first base with a space intervening between the first longitudinal member and the second longitudinal member; the second chess piece includes a second base formed with a first aperture and a second aperture, with the first aperture sized for admittance of the first longitudinal member, and the second aperture sized for admittance of the second longitudinal member; and an elongate member attached to the second base, the elongate member positioned between the first aperture and the second aperture, and the elongate member sized to fit in a space between the first longitudinal member and the second longitudinal member when they pass through the first aperture and the second aperture.

11. The set of chess pieces of claim 10, further including a third chess piece including a third base; a chess piece body attached to the third base; and a first transverse member joined to the chess piece body, wherein the chess piece body is formed with an aperture sized to receive the transverse member from another instance of the third chess piece.

12. The set of chess pieces of claim 10, further including a third chess piece and a fourth chess piece, the third chess piece including a third base and a first chess piece body attached to the third base; the fourth chess piece including a fourth base and a second chess piece body attached to the fourth base, wherein the second chess piece body is formed with a longitudinal void space extending from a top end toward the fourth base, and with the longitudinal void space formed with an interior shaped to accept insertion of the first chess piece body.

13. A chess set, comprising:

a first chess piece, comprising:

a base;

a first chamfered column attached to the base; and a second chamfered column attached to the base with a channel intervening between the first chamfered column and the second chamfered column; and a second chess piece, comprising:

a second base formed with a first aperture and a second aperture, the first aperture sized for admittance of the first chamfered column, and the second aperture sized for admittance of the second chamfered column;

a central interior column attached to the second base, the central interior column positioned between the first aperture and the second aperture, and the central interior column sized to fit between the first chamfered column and the second chamfered column;

a first outer column attached to the second base and to the central interior column; and a second outer column attached to the second base and to the central interior column, the first outer column positioned to slidably engage in the channel.

14. The chess set of claim 13, further comprising a third chess piece, the third chess piece comprising:

a third base;

an angle-faced column attached to the third base, the angle-faced column formed with an angled face extending from a top end of the angle-faced column toward the third base;

a transverse projection extending away from the angled face at the top end, the transverse projection having a nose end opposite an end attached to the angled face; and the angle-faced column formed with a transverse aperture sized to receive the transverse projection from another of the third chess piece, the transverse aperture positioned adjacent the third base.

15. The chess set of claim 13, further comprising:

a third chess piece, comprising:

a third base;

a column attached to the third base; and a tapered upper end attached to the column;

a fourth chess piece, comprising:

a fourth base; and a hollow column attached to the fourth base, the hollow column formed with an aperture shaped to accept the tapered upper end of the third chess piece; and a fifth chess piece, comprising:

a fifth base; and a column formed with an end attached to the fifth base and an opposite end shaped as a spheroidal segment.

16. The chess set of claim 13, further comprising a folding chess board, the folding chess board comprising:

a 1-square-wide panel rotatably connected to a 2-square-wide panel along a first fold line;

a second 1-square-wide panel rotatably connected to the 2-square-wide panel along a second fold line opposite the first fold line;

a second 2-square-wide panel rotatably connected to the second 1-square-wide panel along a third fold line opposite the second fold line; and a third 2-square-wide panel rotatably connected to the second 2-square-wide panel along a fourth fold line opposite the third fold line.

17. A set of chess pieces comprising at least two chess pieces wherein each of the at least two chess pieces has a chess piece rank and has a rank-identifying shape and further configured such that the at least two chess pieces can be combined into a combined unit, wherein the at least two chess pieces comprise a first chess piece having a first base and having a first vertical member and a second vertical member, each vertical member attached to the first base and having separations between them; and a second chess piece having a second base and having a third vertical member and a fourth vertical member, each vertical member attached to the second base and having separations between them; the chess pieces being configured such that the first chess piece and second chess piece can be combined by inserting the first vertical member and the second vertical member into the separations between the third vertical member and the fourth vertical member with the first base and the second base positioned at opposite ends of the combined unit.

* * * * *